US009501010B2

(12) United States Patent
Itoh et al.

(10) Patent No.: US 9,501,010 B2
(45) Date of Patent: Nov. 22, 2016

(54) FIXING APPARATUS

(71) Applicant: CANON KABUSHIKI KAISHA, Tokyo (JP)

(72) Inventors: Masatoshi Itoh, Mishima (JP); Yusuke Isomi, Yokohama (JP); Aoji Isono, Naka-gun (JP); Minoru Hayasaki, Mishima (JP); Hiroshi Mano, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/803,544

(22) Filed: Jul. 20, 2015

(65) Prior Publication Data

US 2016/0026130 A1 Jan. 28, 2016

(30) Foreign Application Priority Data

Jul. 22, 2014 (JP) ..... 2014-148885
Jun. 18, 2015 (JP) ..... 2015-123160

(51) Int. Cl.
*G03G 15/20* (2006.01)

(52) U.S. Cl.
CPC ..... *G03G 15/2053* (2013.01); *G03G 15/2039* (2013.01)

(58) Field of Classification Search
USPC ..... 399/69
See application file for complete search history.

(56) References Cited

U.S. PATENT DOCUMENTS 6,246,843 B1 * 6/2001 Nanataki ..... G03G 15/2003 219/216
6,799,002 B2 * 9/2004 Birumachi ..... G05D 23/1951 399/330
2015/0086256 A1 * 3/2015 Koseki ..... G03G 21/1647 399/360
2015/0168880 A1 * 6/2015 Jota ..... G03G 15/2053 399/333
2015/0168889 A1 * 6/2015 Kita ..... G03G 15/2039 399/33
2015/0168892 A1 * 6/2015 Kuroda ..... G03G 15/2053 399/329
2015/0168896 A1 * 6/2015 Yonekubo ..... G03G 15/2053 399/329

FOREIGN PATENT DOCUMENTS

JP 2003-297542 A 10/2003
JP 2003-317923 A 11/2003
JP 2004-333733 A 11/2004
JP 2014-026267 A 2/2014

* cited by examiner

*Primary Examiner* — David Gray
*Assistant Examiner* — Warren K Fenwick
(74) *Attorney, Agent, or Firm* — Canon U.S.A. Inc., IP Division

(57) ABSTRACT

A fixing apparatus includes a tubular rotation member including a conductive layer, a helical coil, a resonance circuit, including a resonance capacitor, formed with the rotation member and the coil, a resonance inverter configured to control the resonance circuit, and a control unit configured to control electric power supplied to the resonance inverter, wherein the conductive layer generates heat with electromagnetic induction caused by magnetic flux generated through the coil, wherein the control unit sets a driving frequency of the resonance inverter according to at least one of a size of the recording medium and a temperature of a non-sheet-passing portion of the rotation member, and wherein the control unit changes a resonance frequency of the resonance circuit according to the set driving frequency.

22 Claims, 15 Drawing Sheets

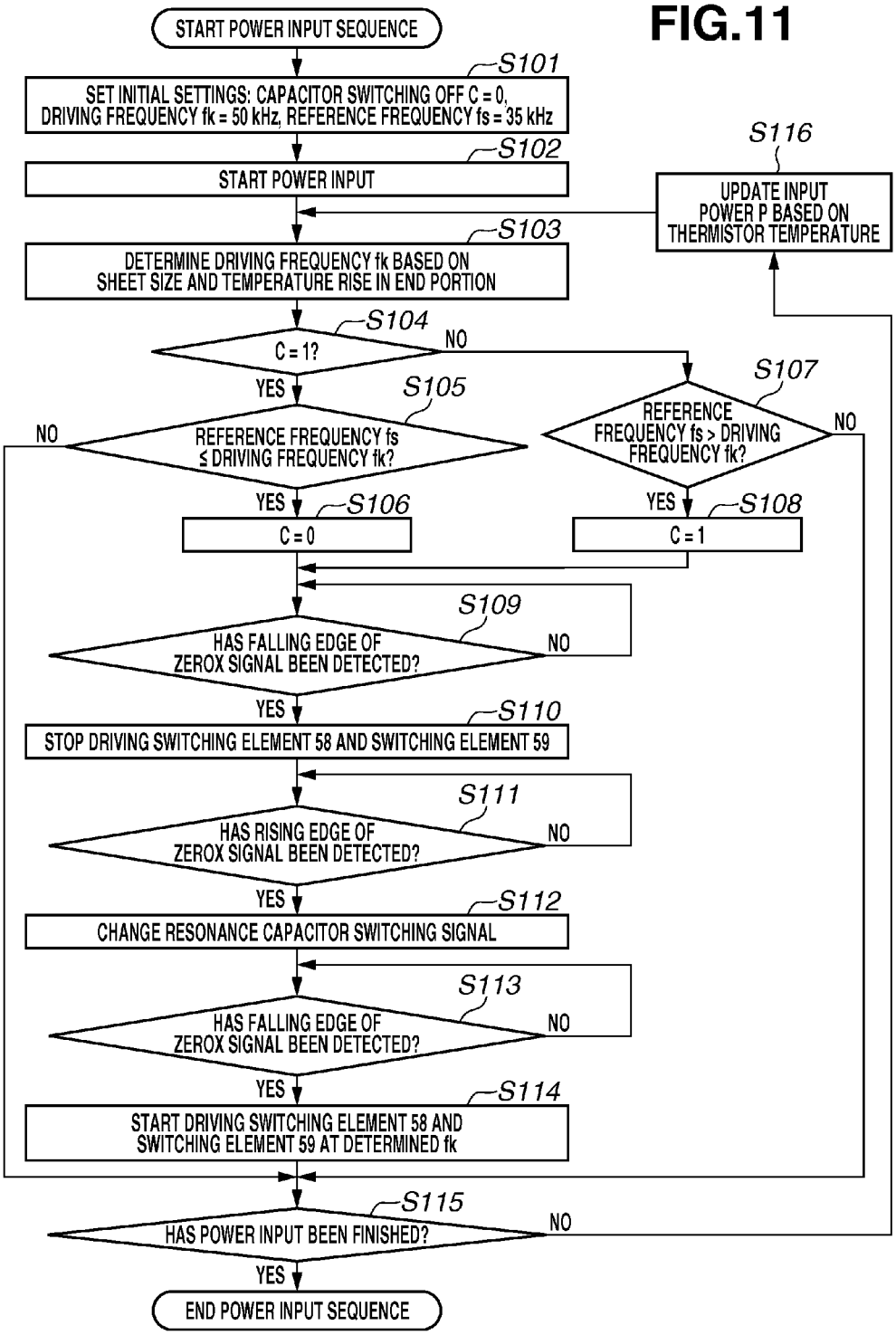
FIG.11
START POWER INPUT SEQUENCE
S101
SET INITIAL SETTINGS: CAPACITOR SWITCHING OFF C = 0, DRIVING FREQUENCY fk = 50 kHz, REFERENCE FREQUENCY fs = 35 kHz
S102
START POWER INPUT
S116
UPDATE INPUT POWER P BASED ON THERMISTOR TEMPERATURE
S103
DETERMINE DRIVING FREQUENCY fk BASED ON SHEET SIZE AND TEMPERATURE RISE IN END PORTION
S104
C = 1?
NO
YES
S105
REFERENCE FREQUENCY fs ≤ DRIVING FREQUENCY fk?
NO
S107
REFERENCE FREQUENCY fs > DRIVING FREQUENCY fk?
NO
YES
S106
C = 0
YES
S108
C = 1
S109
HAS FALLING EDGE OF ZEROX SIGNAL BEEN DETECTED?
NO
YES
S110
STOP DRIVING SWITCHING ELEMENT 58 AND SWITCHING ELEMENT 59
S111
HAS RISING EDGE OF ZEROX SIGNAL BEEN DETECTED?
NO
YES
S112
CHANGE RESONANCE CAPACITOR SWITCHING SIGNAL
S113
HAS FALLING EDGE OF ZEROX SIGNAL BEEN DETECTED?
NO
YES
S114
START DRIVING SWITCHING ELEMENT 58 AND SWITCHING ELEMENT 59 AT DETERMINED fk
S115
HAS POWER INPUT BEEN FINISHED?
NO
YES
END POWER INPUT SEQUENCE

FIXING APPARATUS

BACKGROUND OF THE INVENTION

1. Field of the Invention

The present invention relates to a fixing apparatus installed in an electrophotographic image forming apparatus such as a copy machine and a printer.

2. Description of the Related Art

A fixing apparatus is installed in an electrophotographic image forming apparatus such as a copying apparatus and a printing apparatus. The fixing apparatus generally heats a recording medium bearing an unfixed toner image while conveying the recording medium to fix the toner image on the recording medium in a nip portion formed between a rotatable heating member and a pressure roller that contacts the rotatable heating member.

Recently, a fixing apparatus employing an electromagnetic induction heating system has been developed and practically used. Such a fixing apparatus enables a conductive layer of a rotatable heating member to generate heat, and has an advantage of a short warm-up time.

Japanese Patent Application Laid-Open No. 2014-026267 discusses a fixing apparatus with a few restrictions on thickness and materials of a conductive layer.

However, even the fixing apparatus discussed in Japanese Patent Application Laid-Open No. 2014-026267 has a problem of a temperature rise in a non-sheet-passing portion when a toner image is fixed on a small recording medium.

SUMMARY OF THE INVENTION

The present invention is directed to a fixing apparatus capable of supplying electric power needed for heat generation while forming a heat generation distribution according to a size of a recording medium.

According to an aspect of the present invention, a fixing apparatus configured to fix an image on a recording medium, includes a tubular rotation member including a conductive layer, a helical coil disposed inside the rotation member, the coil having a helical axis in a direction along a generatrix direction of the rotation member, a resonance circuit, including a resonance capacitor, formed with the rotation member and the coil, a resonance inverter configured to control the resonance circuit, and a control unit configured to control electric power supplied to the resonance inverter, wherein the conductive layer generates heat with electromagnetic induction caused by magnetic flux generated through the coil, and the image formed on the recording medium is fixed on the recording medium with heat of the rotation member, wherein the control unit sets a driving frequency of the resonance inverter according to at least one of a size of the recording medium and a temperature of a non-sheet-passing portion of the rotation member, and wherein the control unit changes a resonance frequency of the resonance circuit according to the set driving frequency.

According to another aspect of the present invention, a fixing apparatus configured to fix an image on a recording medium, includes a tubular rotation member including a conductive layer, a helical coil disposed inside the rotation member, the coil having a helical axis in a direction along a generatrix direction of the rotation member, a resonance circuit, including a resonance capacitor, formed with the rotation member and the coil, a resonance inverter configured to control the resonance circuit, and a control unit configured to control electric power supplied to the resonance inverter, wherein the conductive layer generates heat with electromagnetic induction caused by magnetic flux generated through the coil, and the image formed on the recording medium is fixed on the recording medium with heat of the rotation member, wherein the control unit sets a driving frequency of the resonance inverter according to at least one of a size of the recording medium and a temperature of a non-sheet-passing portion of the rotation member, and wherein the control unit changes a resonance frequency of the resonance circuit according to electric power necessary to perform fixing processing.

Further features of the present invention will become apparent from the following description of exemplary embodiments with reference to the attached drawings.

BRIEF DESCRIPTION OF THE DRAWINGS

FIG. 11 is a flowchart illustrating processing performed according to a first exemplary embodiment.

DESCRIPTION OF THE EMBODIMENTS

Hereinafter, exemplary embodiments of the present invention are described in detail with reference to the drawings. Sizes, materials, shapes, and relative arrangements of components described in the exemplary embodiments can be changed appropriately according to various conditions and a configuration of an apparatus to which the present invention is applied. In other words, the scope of the present invention is not limited to the following exemplary embodiments.

Figure 1:
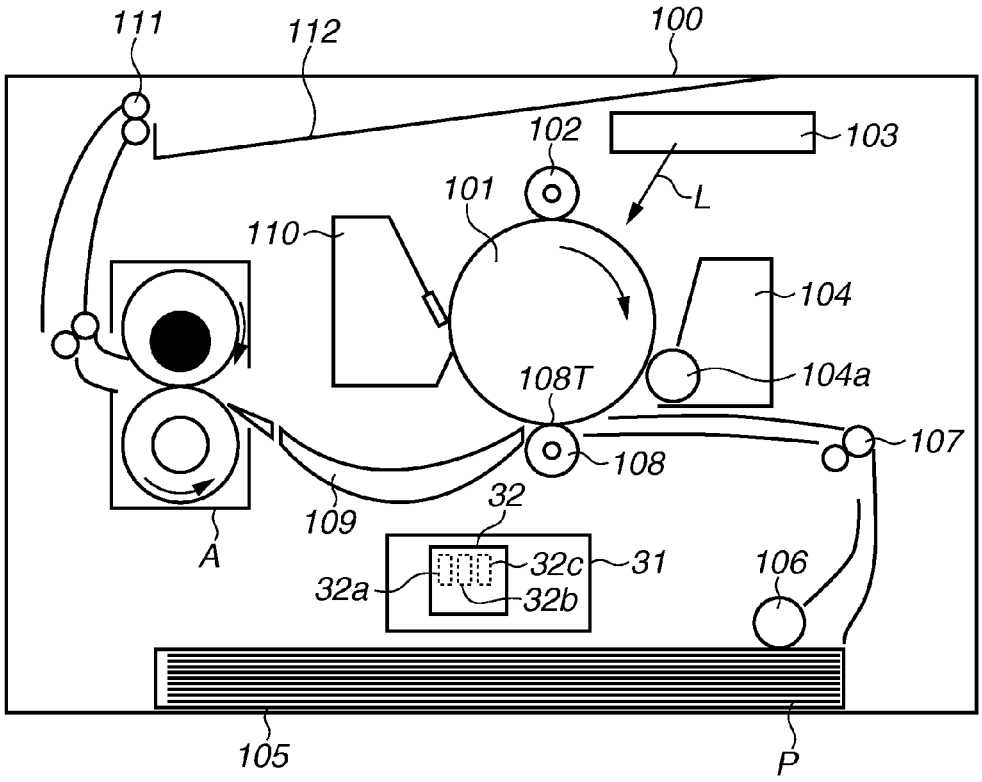
FIG. 1 is a schematic sectional view of an image forming apparatus.

FIG. 1 a schematic diagram illustrating an example image forming apparatus 100 according to a first exemplary embodiment. The image forming apparatus 100 according to the present exemplary embodiment is a laser beam printer using an electrophotographic process.

A controller 31 serving as a control unit of the image forming apparatus 100 includes a central processing unit (CPU) 32 and various input/output control circuits (not illustrated). The CPU 32 includes a read only memory (ROM) 32*a*, a random access memory (RAM) 32*b*, and a timer 32*c*. A rotational drum-type electrophotographic photosensitive member (hereinafter, referred to as photosensitive drum) 101 serving as an image bearing member is rotated in a clockwise direction indicated by an arrow illustrated in FIG. 1 at a predetermined circumferential speed. While rotating, the photosensitive drum 101 is uniformly charged with a predetermined polarity and potential by a contact charging roller 102. A laser beam scanner 103 outputs a laser beam L modulated ON/OFF according to image information input from an external device such as an image scanner (not illustrated) and a computer (not illustrated). The laser beam L is emitted to the charged surface of the photosensitive drum 101, so that an electrostatic latent image corresponding to the image information is formed on the surface of the photosensitive drum 101. A developing device 104 supplies developer (toner) from a developer roller 104*a* to the surface of photosensitive drum 101, and develops the electrostatic latent image on the surface of the photosensitive drum 101 as a toner image. A sheet feed cassette 105 stores recording media P. A registration roller 107 conveys a recording medium P so as to match a leading edge of the toner image formed on the photosensitive drum 101 with a predetermined position of the recording medium P. When a feed start signal is input, a feed roller 106 is driven to feed the recording media P one by one from the sheet feed cassette 105. The registration roller 107 adjusts conveyance timing of the fed recording medium P. Subsequently, the recording medium P is introduced into a transfer portion 108T at which the photosensitive drum 101 and a transfer roller 108 contact each other. While the recording medium P is pinched and conveyed by the transfer portion 108T, a power source (not illustrated) applies a transfer bias to the transfer roller 108. Since the transfer bias having a polarity opposite to that of the charge of the toner is applied to the transfer roller 108, the toner image on the photosensitive drum 101 is transferred to the recording medium P. The recording medium P with the transferred toner image thereon is separated from the surface of the photosensitive drum 101, and then introduced to a fixing unit A via a conveyance guide 109. The toner image on the recording medium P is heated and fixed on the recording medium P by the fixing unit A. After passing the fixing unit A, the recording medium P is discharged to a discharge tray 112 via a paper discharge port 111. On the other hand, after the recording medium P is separated from the photosensitive drum 101, the surface of the photosensitive drum 101 is cleaned by a cleaning unit 110.

Figure 2:
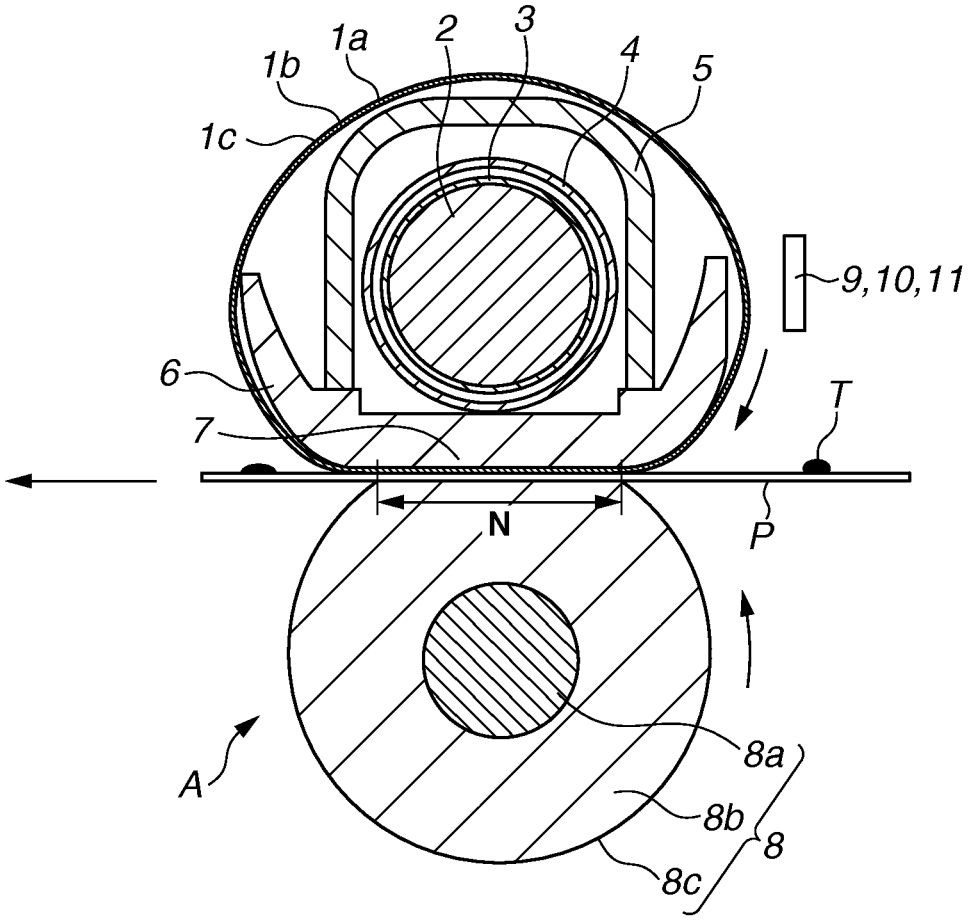
FIG. 2 is a sectional view of a fixing unit.
Figure 3:
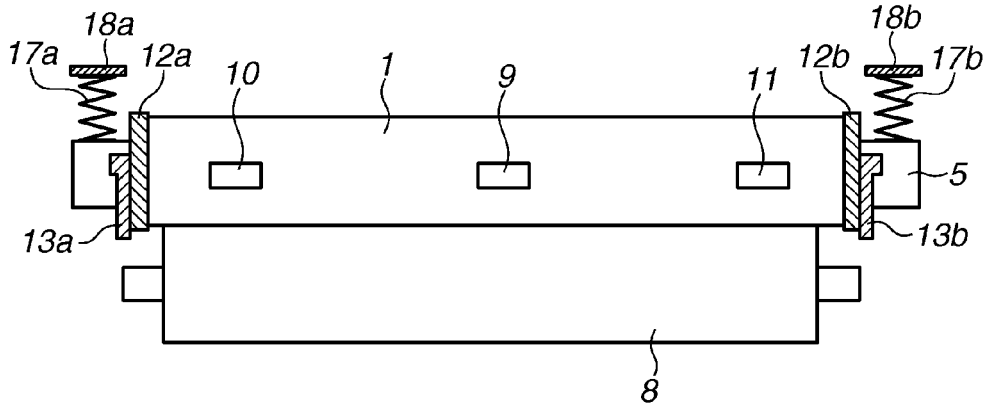
FIG. 3 is a front view illustrating the fixing unit.
Figure 4:
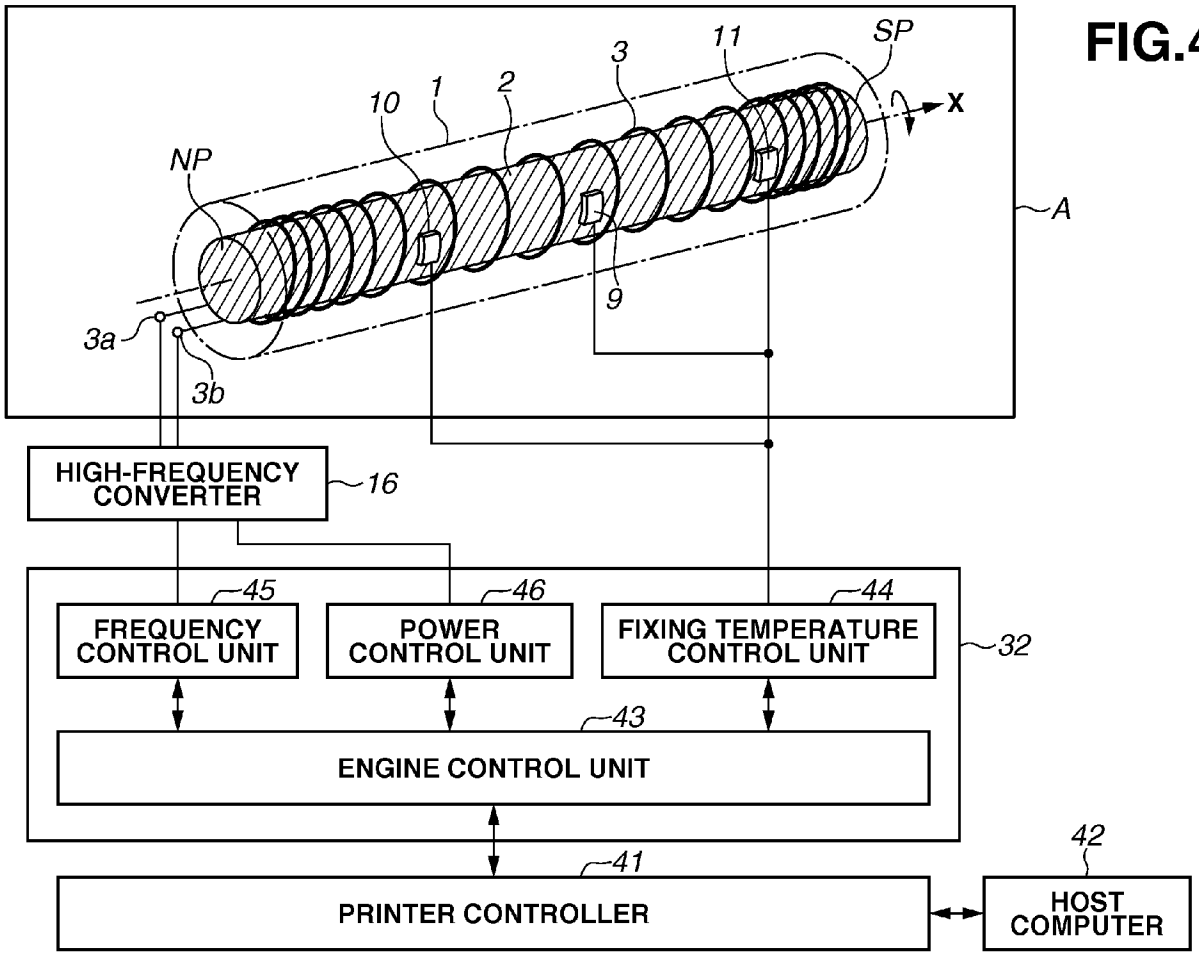
FIG. 4 is a perspective view of a coil unit disposed in the fixing unit.

The fixing unit A serves as a fixing apparatus employing an electromagnetic induction heating system. Specifically, the fixing unit A uses magnetic flux generated by a helical coil to cause a conductive layer of a rotation member to generate heat by electromagnetic induction. Thus, the fixing unit A fixes the image formed on the recording medium P using the heat of the rotation member. The magnetic flux generated by the helical coil is provided in a direction along a generatrix direction of the rotation member. FIG. 2 is a sectional view of the fixing unit A, and FIG. 3 is a front view of the fixing unit A. FIG. 4 is a perspective view of a coil unit disposed in the fixing unit A. The fixing unit A includes a pressure roller 8 serving as a pressure member and a heating unit that includes the coil unit and a fixing sleeve 1 which will be described below. In the fixing unit A, a fixing nip portion N is formed between the heating unit and the pressure roller 8. The fixing nip portion N pinches and conveys a recording medium P bearing an unfixed toner image.

The pressure roller 8 serving as a pressure member includes a metal core 8*a*, an elastic layer 8*b* made of a material such as silicone rubber, and a release layer 8*c* made of a material such as fluorine resin. Both ends of the metal core 8*a* are rotatably held between apparatus chassis (not illustrated) of the fixing unit A via bearings. Moreover, as illustrated in FIG. 3, pressure springs (compression springs in this example) 17*a* and 17*b* are provided between both ends of a pressure stay (metal-made reinforcing member) 5 and respective spring bearing members 18*a* and 18*b* on the apparatus chassis side, so that a push down force acts on the pressure stay 5. In the fixing unit A according to the present exemplary embodiment, a total pressing force of approximately between 100 N and 250 N (approximately between 10 kgf and 25 kgf) is applied. Thus, a bottom of a sleeve guide member 6 made of heat-resistant resin (e.g., polyphenylene sulfide (PPS)) and the pressure roller 8 press against each other with the fixing sleeve 1 pinched therebetween, thereby forming the fixing nip portion N. The pressure roller 8 is driven in a direction indicated by an arrow illustrated in FIG. 2 by a drive unit (not illustrated). The fixing sleeve 1 is rotated by the rotation of the pressure roller 8. Flange members 12*a* and 12*b* are rotated by the rotation of the fixing sleeve 1. The flange members 12*a* and 12*b* are rotatably arranged at end portions of the sleeve guide member 6 in a longitudinal direction. When the fixing sleeve 1 laterally moves toward the generatrix direction while rotating, the fixing sleeve 1 contacts the flange member 12*a* (12*b*). Then, the flange member 12*a* (12*b*) pushed by the fixing sleeve 1 contacts a regulation member 13*a* (13*b*). This enables the lateral movement of the fixing sleeve 1 to be regulated by the regulation members 13*a* (13*b*). Each of the flange members 12*a* and 12*b* is made of a material such as liquid crystal polymer (LCP) having good heat resistance.

A diameter of the fixing sleeve 1 serving as a rotatable tubular member is desirably between 10 mm and 50 mm. The fixing sleeve 1 includes a heat generation layer (also referred to as a conductive layer) 1*a* serving as a base layer, an elastic layer 1*b* laminated on an outer surface of the heat generation layer 1*a*, and a release layer 1*c* serving as a sleeve surface. The heat generation layer 1*a* is a metal film (the sleeve of this example is made of stainless steel), and a film thickness thereof is desirably between 10 μm and 50 μm. The elastic layer 1*b* is made of silicone rubber. A desirable hardness and a desirable thickness of the elastic layer 1*b* are approximately 20 degrees (JIS-A, 1 kg load) and between 0.1 mm and 0.3 mm, respectively. The release layer 1*c* is a tube made of fluorine resin, and a thickness thereof is desirably between 10 μm and 50 μm. On the heat generation layer 1*a*, an induced current is generated by the action of alternating magnetic flux, which will be described below. The heat generation layer 1*a* generates heat by the induced current, and this heat is transferred to the elastic layer 1*b* and the release layer 1*c*, thereby heating an entire circumferential direction of the fixing sleeve 1. Temperature detection elements 9, 10, and 11 for detecting temperature of the fixing sleeve 1 will be described below.

Next, the mechanism for generating an induced current in the heat generation layer 1*a* is described in detail. FIG. 4 is a perspective view illustrating a coil unit disposed in the heating unit. The coil unit includes a coil 3 serving as an energizing coil disposed inside the rotation member (fixing sleeve 1). The coil 3 has a helical portion with a helical axis that is substantially parallel to a generatrix direction of the rotation member. The coil 3 forms an alternating magnetic field for causing the conductive layer 1*a* of the rotation member to generate heat by electromagnetic induction. The fixing unit A includes only one coil (i.e., coil 3) inside the rotation member. Moreover, the coil unit includes a magnetic core 2 disposed inside the helical portion. The magnetic core 2 induces magnetic flux. The helical axis is provided in a direction along the generatrix direction of the rotation member. The magnetic core 2 serving as a magnetic core member passes through a hollow portion of the fixing sleeve 1 and is disposed by a stationary unit (not illustrated). In FIG. 4, the magnetic core 2 has magnetic poles of a north pole (NP) and a south pole (SP). The magnetic core 2 has ends, and the magnetic flux generated by the coil 3 forms an open magnetic circuit. The magnetic core 2 may desirably include a ferromagnet that is made of a material with a low hysteresis loss and a high relative permeability, for example, high-permeability oxide and alloy such as baked ferrite, ferrite resin, amorphous alloy, and permalloy. In this example, baked ferrite having a relative permeability of 1800 is used. In this example, the magnetic core 2 has a cylindrical shape, and a diameter thereof is desirably between 5 mm and 30 mm. In a case where the fixing unit A serving as a fixing apparatus is installed in an A4 printer, a desirable length of the magnetic core 2 is approximately 240 mm. The magnetic core 2 with the coil 3 is covered with a resin cover 4.

The energizing coil 3 is formed by helically winding a single conducting wire around the magnetic core 2 in the hollow portion of the fixing sleeve 1. The conducting wire is wound so that intervals at end portions of the magnetic core 2 are denser than those at a center portion of the magnetic core 2. The coil 3 is made from 18 turns with respect to the magnetic core 2 having a longitudinal length of 240 mm. The conducting wire is wound to have intervals of 10 mm between the turns at the end portions of the magnetic core 2, and intervals of 20 mm between the turns at the center portion. Moreover, the conducting wire is wound to have intervals of 15 mm between the turns at a portion between the end potions and the center portion. In this way, coil 3 is wound around in a direction intersecting with an axial direction X of the magnetic core 2.

When a high-frequency converter 16 applies a high-frequency current to the energizing coil 3 via power feeding contact portions 3*a* and 3*b*, magnetic flux is generated. The fixing unit A of this example is designed so that most (70% or more, desirably 90% or more, more desirably 94% or more) of the magnetic flux from one end of the magnetic core 2 returns to the other end of the magnetic core 2 by passing outside the heat generation layer 1*a* of the fixing sleeve 1. Accordingly, on the heat generation layer 1*a* of the fixing sleeve 1, an induced current flowing in a circumferential direction of the heat generation layer 1*a* is generated so as to generate magnetic flux that cancels the magnetic flux passing outside the sleeve. Therefore, heat is generated in the entire circumferential direction of the heat generation layer 1*a*. The heat generation layer according to the present exemplary embodiment mainly uses an induced current flowing in a circumferential direction of the conductive layer to generate heat. Accordingly, in a case where the induced current flows in a circumferential direction of the fixing sleeve 1, heat is generated in the entire circumferential direction of the fixing sleeve 1. Thus, there is an advantage of reducing a warm-up time needed for the fixing unit A to reach a fixable temperature. Moreover, the magnetic core 2 has the ends, and most of the magnetic flux passes outside the heat generation layer 1*a* by the open magnetic circuit. Therefore, there is an advantage that size of the fixing unit A can be made smaller than an apparatus in which a core has a loop shape to form a closed magnetic circuit.

As illustrated in FIG. 2, the temperature detection elements 9, 10, and 11 of the fixing unit A are arranged on an upstream side of the fixing sleeve 1 in a rotation direction relative to the fixing nip portion N. The temperature detection elements 9, 10, and 11 detect surface temperature of the fixing sleeve 1. Moreover, in a longitudinal direction of the fixing unit A as illustrated in FIG. 3, the temperature detection element 9 detects temperature of a middle portion of the fixing sleeve 1, whereas the temperature detection elements 10 and 11 detect temperature of end portions of the fixing sleeve 1. Each of the temperature detection elements 9, 10, and 11 includes a thermistor or the like. The power to be supplied to the coil 3 is controlled so that a temperature detected by the temperature detection element 9 disposed in the middle portion is maintained at a control target temperature suitable for fixing operation. Moreover, the temperature detection elements 10 and 11 disposed near the respective ends of the fixing sleeve 1 can detect a temperature rise in a non-sheet-passing portion of the fixing sleeve 1 when continuous printing of small recording media P is performed. Alternatively, the temperature detection elements 10 and 11 may be disposed at end portions of the pressure roller 8 in an axial direction to detect a temperature rise in a non-sheet-passing portion of the pressure roller 8 when continuous printing of small recording media P is performed.

FIG. 4 is a block diagram illustrating a relationship between the CPU 32, a printer controller 41, and a host computer 42. The CPU 32 serves as a control unit for performing printer control. The printer controller 41 communicates with the host computer 42 (described below), receives image data, and rasterizes the received image data into information printable by the image forming apparatus 100. Moreover, the printer controller 41 exchanges signals, and performs serial communications with the engine control unit 43. The engine control unit 43 exchanges signals with the printer controller 41, and controls each of units 44 to 46 of the image forming apparatus 100 via the serial communications. A fixing temperature control unit 44 controls a temperature of the fixing unit A based on the temperatures detected by the temperature detection elements 9, 10, and 11. The fixing temperature control unit 44 also detects an abnormality of the fixing unit A. A frequency control unit 45 serving as a frequency controller controls a driving frequency of the high-frequency converter 16, and a power control unit 46 controls electric power of the high-frequency converter 16 by turning on/off the driving of the high-frequency converter 16. More specifically, the power control unit 46 turns on/off the driving of the high-frequency converter 16 so that a detected temperature of the temperature detection element 9 is maintained at a control target temperature. The host computer 42 transfers image data to the printer controller 41. The host computer 42 sets various printing conditions such as a size of a recording medium P in the printer controller 41 according to a request from a user.

Figure 5:
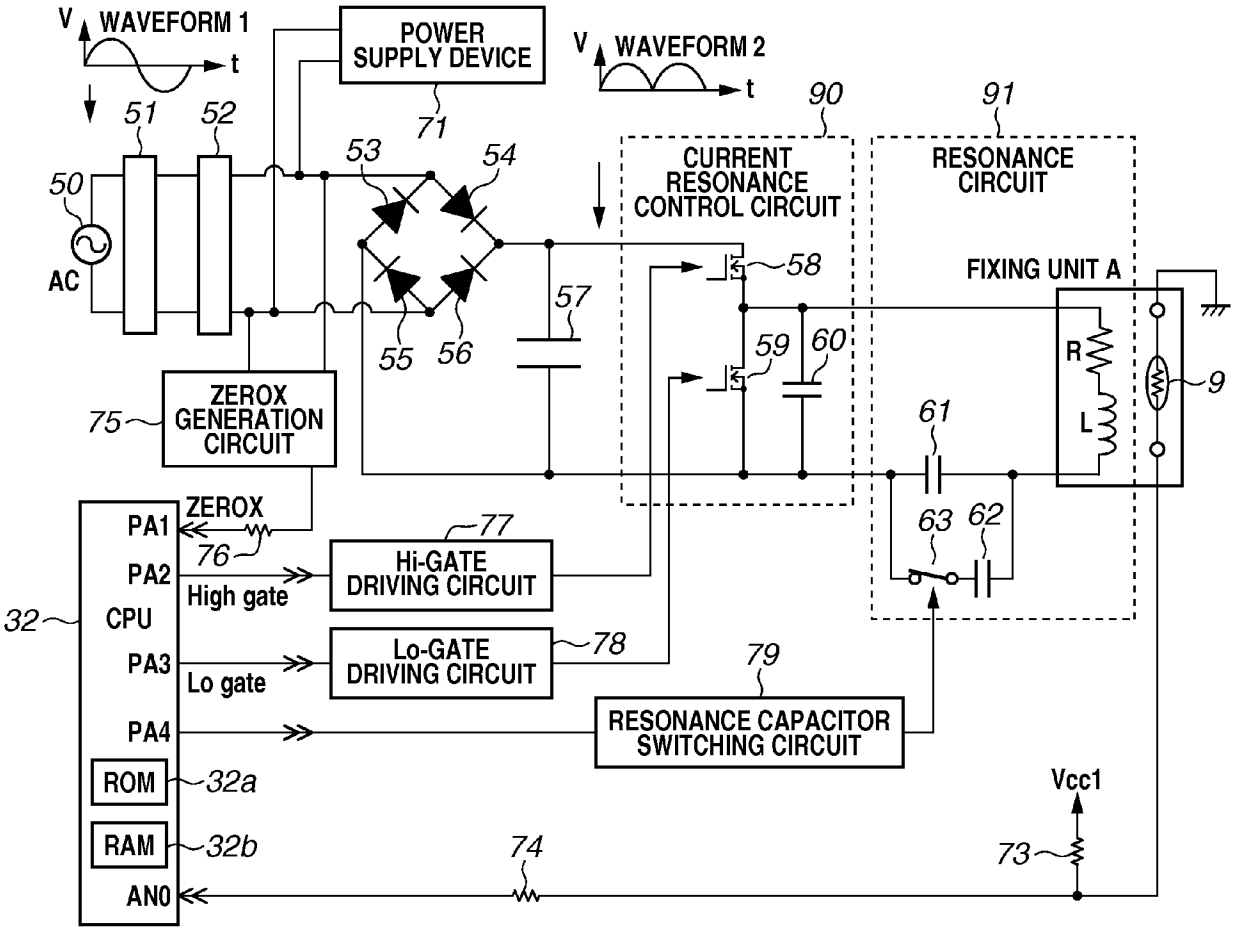
FIG. 5 is a coil unit driving circuit diagram.

FIG. 5 is a circuit diagram illustrating a driving circuit including the high-frequency converter 16 according to the present exemplary embodiment. A commercial power supply 50 serving as an alternating-current power supply, to which the image forming apparatus 100 is connected, supplies alternating-current power to the image forming apparatus 100 via an inlet 51. This circuit includes a primary side directly connected to the commercial power supply 50, and a secondary side connected to the commercial power supply 50 in a non-contact manner. The commercial power supply 50 outputs voltage having a waveform of a waveform 1 illustrated in FIG. 5, where a horizontal axis and a vertical axis indicate time and voltage, respectively. Electric power that is input from the commercial power supply 50 is input to diode bridges 53 to 56 via the inlet 51 and an alternating current (AC) filter 52 to undergo full-wave rectification. After the rectified voltage is charged to a capacitor 57, the rectified voltage has a voltage waveform of a waveform 2 illustrated in FIG. 5. The waveform 2 is expressed using a horizontal axis and a vertical axis indicating time and voltage, respectively. This waveform is input to a current resonant control circuit 90 (corresponding to the high-frequency converter 16 illustrated in FIG. 4) including switching elements (i.e., field effect transistors (FETs)) and 59 and a voltage resonance capacitor 60. Thus, power is supplied to a resonance circuit 91 including an equivalent inductance L and an equivalent resistance R of the fixing unit A, and resonance capacitors 61 and 62. The current resonant control circuit 90 (high-frequency converter 16) serves as a resonance inverter in a narrow sense.

A power supply device (a power supply unit) 71 receives the power of the commercial power supply 50 via the AC filter 52, and then outputs a predetermined voltage to a secondary side load (e.g., a motor) (not illustrated). The CPU 32 is also used for operating the current resonant control circuit 90. The CPU 32 includes input-output ports, the ROM 32*a*, and the RAM 32*b*. The high-frequency converter 16, the resonance circuit 91, and members arranged before a primary coil of a transformer inside the power supply device 71 for supplying power to the secondary side are directly connected to the commercial power supply 50, and electrically serve as a primary side circuit. Moreover, members that are arranged beyond a secondary coil of the transformer inside the power supply device 71 are connected to the commercial power supply 50 in a non-contact manner and electrically serve as a secondary side circuit. Such members arranged beyond the secondary coil are, for example, a motor and a unit such as a motor (not illustrated) for rotating the photosensitive drum 101 and the laser beam scanner 103 that operate when an image is formed.

Meanwhile, electric power of the commercial power supply 50 is input to a ZEROX generation circuit 75 via the AC filter 52. The ZEROX generation circuit 75 outputs a High-level (or Low-level) signal if the commercial power supply voltage is a threshold voltage or lower, which is a certain voltage around zero voltage. If the commercial power supply voltage is other than the threshold voltage or lower, the ZEROX generation circuit 75 outputs a Low-level (or High-level) signal. Then, a pulse signal having a cycle substantially similar to that of the commercial power supply voltage is input to an input port PA1 of the CPU 32 through a resistance 76. The CPU 32 detects an edge of a ZEROX signal that changes from High to Low or from Low to High, and uses the detected edge as a trigger to drive the current resonant control circuit 90.

Next, the current resonant control circuit 90 is described. When the CPU 32 outputs a pulse signal having a frequency, which will be described below, from an output port PA 2 to a Hi-gate driving circuit 77, the Hi-gate driving circuit 77 outputs a gate waveform toward the switching element 58. During a period in which the gate waveform is Hi, the switching element 58 turns on a drain-to-source. The switching element 58 turns off the drain-to-source during a period in which the gate waveform is Lo. Similarly, when the CPU 32 outputs a pulse signal, which has a frequency substantially the same as a pulse signal to the Hi-gate driving circuit 77, from an output port PA3 to a Lo-gate driving circuit 78, the Lo-gate driving circuit outputs a gate waveform to a switching element 59. During a period in which the gate waveform is Hi, the switching element 59 turns on a drain-to-source. The switching element 59 turns off the drain-to-source during a period in which the gate waveform is Lo. The switching elements 58 and 59 are alternately turned on with a frequency of a pulse signal to supply a square wave to the resonance circuit 91. This allows the equivalent inductance L of the fixing unit A and the resonance capacitor 61 to resonate, and the fixing sleeve 1 serving as a rotation member of the fixing unit A generates heat. An ON duty ratio (i.e., ON time ratio with respect to one cycle of a pulse signal) of a pulse signal to the Hi-gate driving circuit 77, and an ON duty ratio of a pulse signal to the Lo-gate driving circuit 78 are set to approximately 50% regardless of frequencies of the pulse signals. Moreover, if a frequency changing unit (hereinafter, referred to as a resonance capacitor switching element) 63 serving as a changing unit is in a conductive state, the resonance capacitors 61 and 62 resonate. When the pulse signals to the switching elements 58 and 59 are stopped, the heat generation of the fixing unit A stops.

The temperature detection element 9 disposed in the fixing unit A has one end connected to the ground. The other end of the temperature detection element 9 is connected to a power supply Vcc1 via a resistance 73, and is further connected to an analog input port AN0 of the CPU via a resistance 74. Outputs of the temperature detection elements 10 and 11 (not illustrated in FIG. 5) for detecting temperature of end portions of the fixing unit A are also input to the analog input port AN0 of the CPU 32, similar to the temperature detection element 9. The thermistor used as the temperature detection element 9 has characteristics in which a resistance value decreases with increasing temperature. The CPU 32 converts a divided voltage of the fixed resistance 73 with detection element 9 into a temperature based on a temperature table (not illustrated) that is set beforehand to detect a temperature of the fixing unit A (more precisely, a temperature of the fixing sleeve 1). Moreover, the CPU 32 uses a ZEROX signal as a trigger to control the driving of the switching elements 58 and 59 so as to maintain the temperature of the fixing unit A at a predetermined temperature (control target temperature) during fixing processing.

In a case where fixing processing is performed on a small recording medium, a detected temperature of the temperature detection element 10 or 11 increases, the temperature detection element 10 or 11 for detecting the temperature of a non-sheet-passing portion of the small recording medium. If the detected temperature exceeds a reference temperature, the CPU 32 changes a driving frequency of each of the switching elements 58 and 59. Moreover, the CPU 32 outputs a signal from an output port PA4 to a resonance capacitor switching circuit 79. When the CPU 32 outputs the signal from the output port PA4 to the resonance capacitor switching circuit 79, the resonance capacitor switching circuit 79 turns on the resonance capacitor switching element 63. Thus, the resonance capacitor 61 and the resonance capacitor 62 are connected in parallel. The resonance capacitor switching circuit 79 changes the presence or absence of the resonance capacitor 62, so that a resonance frequency f (see Equation 1) determined by the equivalent inductance L of the fixing unit A and the resonance capacitor 61, changes. In this example, the driving frequency is changed according to a detected temperature of the temperature detection element or 11. However, a driving frequency may be changed according to recording medium size information. A driving frequency can be set according to at least one of the size of a recording medium and temperature of a non-sheet-passing portion of the fixing sleeve 1.

$$f = \frac{1}{2\pi\sqrt{LC}} \quad \text{Equation 1}$$

Figure 6:
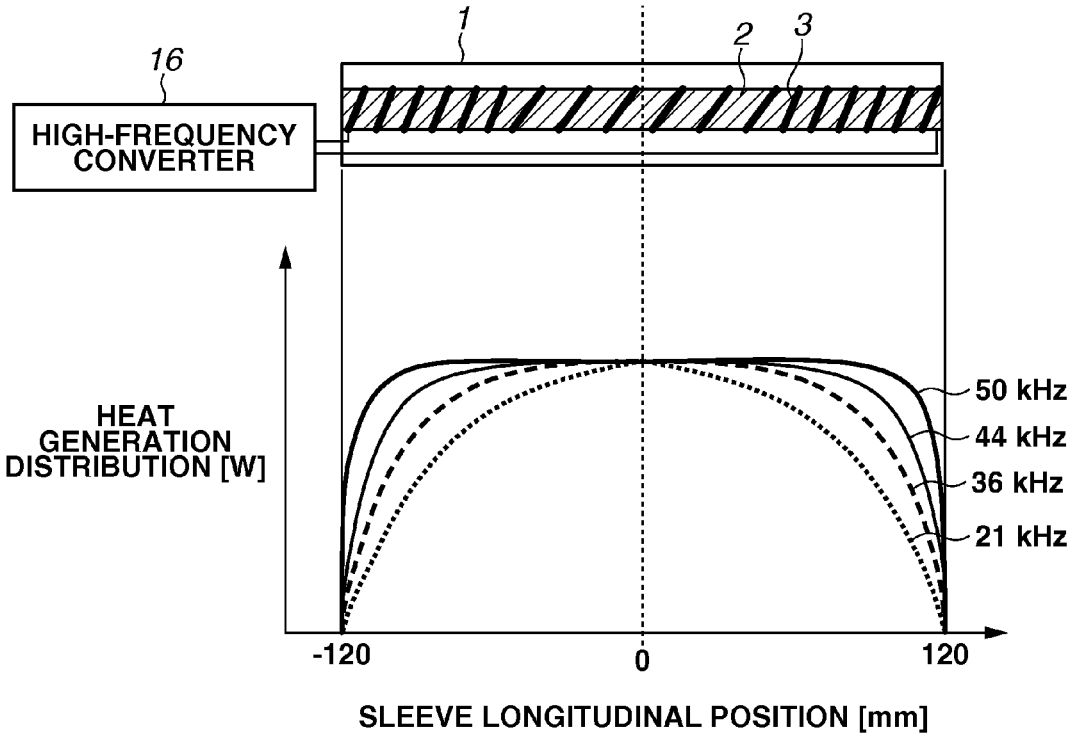
FIG. 6 is a diagram illustrating a relationship between a driving frequency and a heat generation distribution of a fixing sleeve.

In the apparatus, 70% or more of the magnetic flux generated in the coil may pass outside the conductive layer of the fixing sleeve. In such a case, a heat generation distribution of the fixing sleeve 1 changes as illustrated in FIG. 6 according to a frequency (hereinafter, referred to as a driving frequency fk) for turning on and off the switching elements 58 and 59. Such a characteristic is used to change the driving frequency fk according to the size of a recording medium P or a temperature rise in an end portion of the fixing sleeve 1. Therefore, the change in the heat generation distribution of the fixing sleeve 1 can suppress the temperature rise in the end portion of the fixing sleeve 1.

However, in a case where the driving frequency fk is changed to change the heat generation distribution of the fixing sleeve 1, the fixing unit A may not obtain the electric power necessary to fix a toner image. Such a problem is described below.

Figure 7:
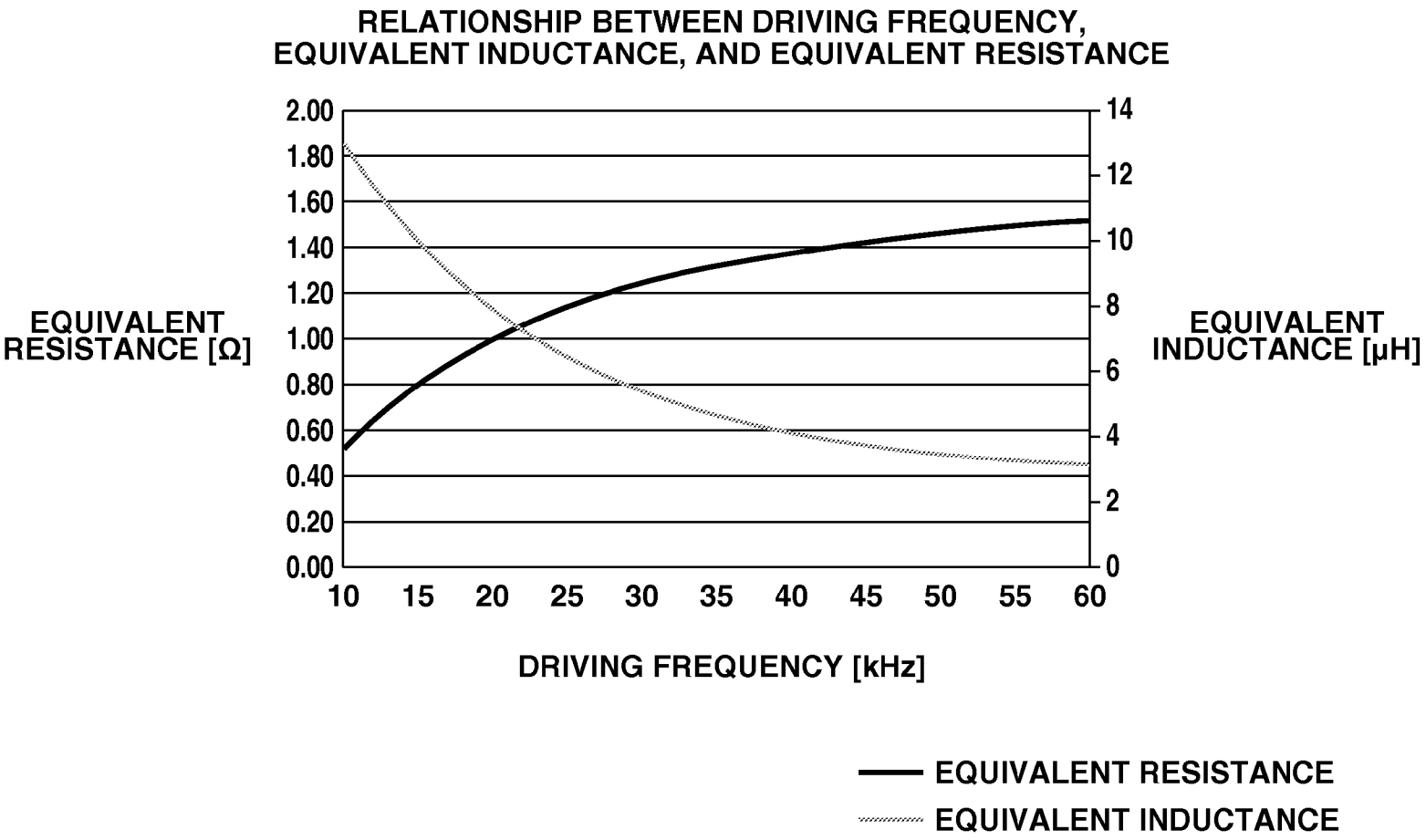
FIG. 7 is a graph illustrating a relationship between a driving frequency and an equivalent inductance, and a relationship between the driving frequency and an equivalent resistance.

FIG. 7 is a graph illustrating a relationship between the driving frequency fk and the equivalent resistance R of the fixing unit A, and a relationship between the driving frequency fk and the equivalent inductance L. As illustrated in FIG. 7, the higher the driving frequency fk, the higher the equivalent resistance R. The higher the driving frequency fk, the lower the equivalent inductance L.

Figure 8:
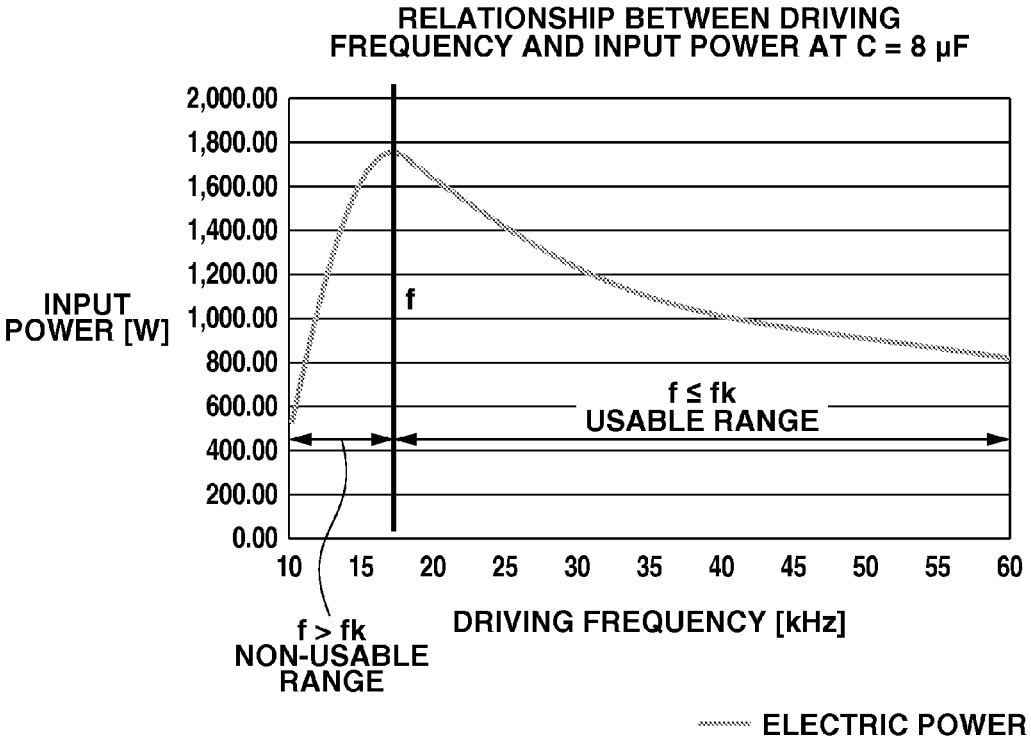
FIG. 8 is a graph illustrating a relationship between a driving frequency and an input power.

FIG. 8 is a graph illustrating a relationship between a driving frequency fk and an input power to the fixing unit A where a parallel combined capacity of the resonance capacitors 61 and 62 is 8 μF in an ON state of the resonance capacitor switching element 63. The power to be input to the fixing unit A is electric power to be consumed by the equivalent resistance R in a series resonant RLC circuit including the equivalent resistance R and the equivalent inductance L of the fixing unit A and the resonance capacitors 61 and 62. Such input power can be calculated by Equation 2.

$$P = \frac{V^2 \cdot R}{\sqrt{R^2 + \left(2\pi fk * L - \frac{1}{2\pi fk * C}\right)^2}} \quad \text{Equation 2}$$

As illustrated in FIG. 8, if a heat generation distribution suitable for a width of a small sheet is formed, that is, if the driving frequency fk is low (e.g., kHz), power of approximately 1600 W can be input. However, if a heat generation distribution suitable for a large sheet is formed, that is, if the driving frequency fk is high (e.g., 50 kHz), only a power of approximately 900 W can be input. In other words, as illustrated in FIG. 6, if the driving frequency fk is set to 50 kHz for heat generation in an entire longitudinal direction of the fixing sleeve 1, an upper limit of inputtable power is approximately 900 W.

Figure 9:
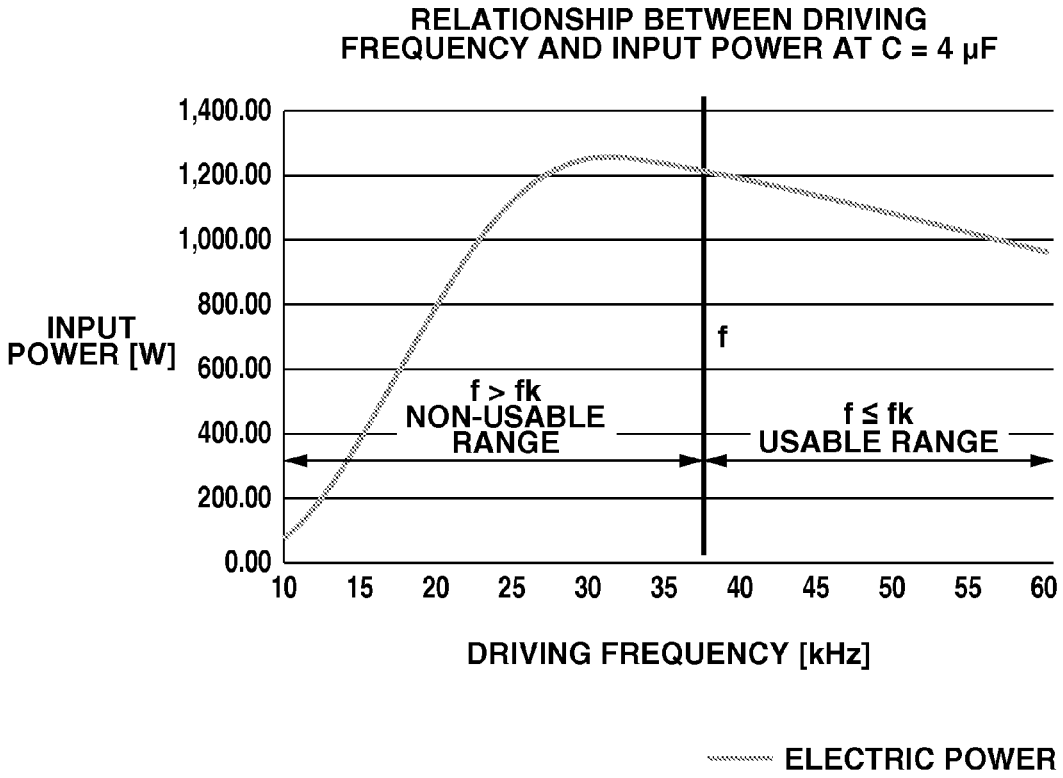
FIG. 9 is a graph illustrating a relationship between a driving frequency and an input power.

FIG. 9 is a graph illustrating a relationship between a driving frequency fk and an input power to the fixing unit A where a capacity of only the resonance capacitor 61 is 4 μF in an OFF state of the resonance capacitor switching element 63. The input power to the fixing unit A can be calculated by Equation 2 as similar to FIG. 8. In FIG. 9, even if the driving frequency fk is 50 kHz, power of 1050 W or more can be supplied. However, if the driving frequency fk becomes lower than a resonance frequency f, a phenomenon called off-resonance occurs. Such a phenomenon damages the switching elements 58 and 59. Consequently, if the resonance capacitor switching element is in an OFF state, a range in which the resonance frequency f>the driving frequency fk illustrated in FIG. 9 cannot be used.

In the present exemplary embodiment, therefore, an ON/OFF state of the resonance capacitor switching element 63 is controlled so that the driving frequency fk becomes constantly higher than the resonance frequency f. This enables sufficient power to be supplied without off-resonance.

Figure 10:
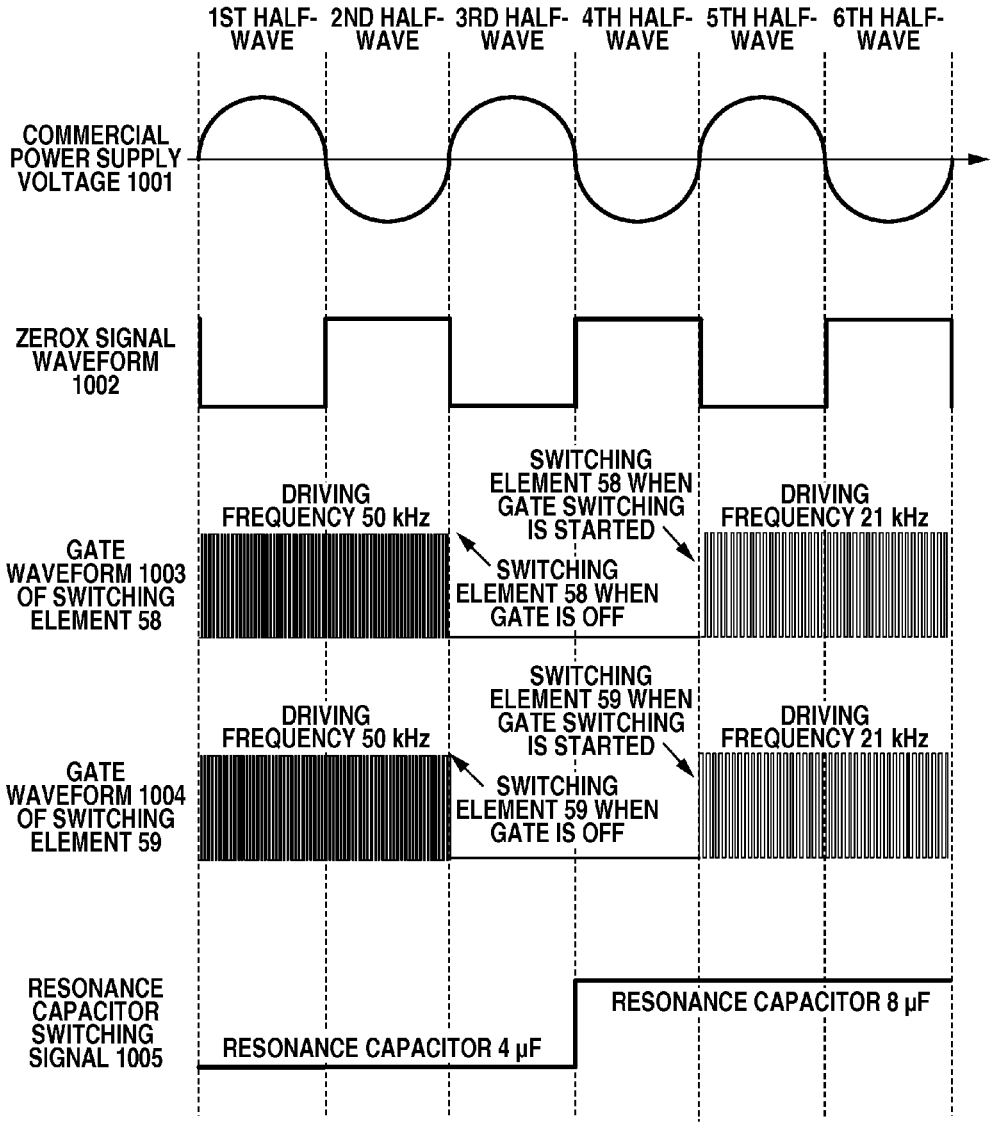
FIG. 10 is a diagram illustrating waveforms when a capacity of a resonance capacitor is changed.

FIG. 10 is a diagram illustrating a relationship between a driving frequency and a capacity of a resonance capacitor, and change timing when a heat generation distribution suitable for a large sheet is changed to a heat generation distribution suitable for a small sheet. In FIG. 10, each of a commercial power supply voltage 1001, a ZEROX signal waveform 1002, a gate waveform 1003 of the switching element 58, a gate waveform 1004 of the switching element 59, and a resonance capacitor switching signal 1005 is illustrated with a corresponding horizontal axis indicating time. The capacity of the resonance capacitor is changed as follows. Application of power is stopped in synchronization with a falling edge of a ZEROX signal like the gate waveform 1003 and the gate waveform 1004, and the capacity of the resonance capacitor is changed from 4 μm to 8 μm at a rising edge of the ZEROX signal. Driving of each of the gate waveform 1003 and the gate waveform 1004 is started at a next falling edge of the ZEROX signal. At that time, the driving is performed at a frequency in such a manner that the relationship of "the resonance frequency f≤the driving frequency fk" is satisfied. The driving frequency fk is set to higher than or equal to the resonance frequency f, so that the switching elements 58 and 59 are not damaged. Moreover, the capacity of the resonance capacitor is changed after the driving of the switching elements 58 and 59 is turned off. This suppresses damage to the switching element 58 and the switching element 59.

Accordingly, such a capacity of the resonance capacitor switching operation is performed, so that sufficient power can be supplied without off-resonance and regardless of the driving frequency fk. In the present exemplary embodiment, the driving of the switching elements 58 and 59 is stopped and started, and the capacity of the resonance capacitor is changed in synchronization with a ZEROX signal. However, the timing at which the driving of the switching elements 58 and 59 is stopped and started, and the capacity of the resonance capacitor is changed, is not limited to that descried in the present exemplary embodiment. Moreover, the present exemplary embodiment is described using the example case in which the capacity of the resonance capacitor is changed. However, the fixing unit A may include an inductor (not illustrated) and an inductance changing circuit (not illustrated) arranged in series. In such a case, the inductance may be changed to change the resonance frequency f. As long as the resonance frequency f can be changed, the configuration thereof is not limited to that described in the present exemplary embodiment. Thus, a resonance member including a capacitor and an inductor may be formed in various configurations.

FIG. 11 is a flowchart illustrating processing of a power input sequence, including a capacity changing operation, performed by the CPU 32 according to the present exemplary embodiment. In step S101, when the power input sequence is started, the CPU 32 sets a capacitor switching state, a driving frequency fk of 50 kHz, and a reference frequency fs of 35 kHz as initial settings. The reference frequency fs is stored beforehand in a storage area of the CPU 32. In this example, the reference frequency is set to a frequency substantially the same as a resonance frequency obtained when the capacity of the resonance capacitor is 4 μF. The term "capacitor switching state" used herein is expressed by C=1 indicating that the resonance capacitor switching element 63 is ON, or C=0 indicating that the resonance capacitor switching element 63 is OFF. The term "reference frequency fs" used herein represents a frequency used to determine whether a capacitor switching is needed, and is set to higher than the frequency f obtained when a resonance capacitor switching signal is C=0. In the present exemplary embodiment, the reference frequency fs is a predetermined value in a frequency range that is higher than the resonance frequency f illustrated in FIG. 9. Subsequently, in step S102, the CPU 32 starts to input power. In step S103, the CPU 32 determines a driving frequency fk based on a sheet size or a temperature rise in an end portion of the fixing unit A. In step S104, the CPU 32 checks a current capacitor switching state. In each of steps S105 and S107, the CPU 32 checks matching between the resonance capacitor state being currently set and the driving frequency fk to determine whether a capacitor switching is needed. More specifically, if the current resonance capacitor switching signal is C=1, a capacitor corresponding to a low frequency is being connected. If the capacitor corresponding to the low frequency is set as a resonance capacitor, the driving needs to be performed at a driving frequency fk that is lower than the reference frequency fs. On the other hand, if the current resonance capacitor switching signal is C=0, a capacitor corresponding to a high frequency is being connected. If the capacitor corresponding to the high frequency is set as a resonance capacitor, the driving needs to be performed at a driving frequency fk that is higher than or equal to the reference frequency fs. If the CPU 32 determines that a capacitor switching is needed upon checking the matching between the resonance frequency f and the driving frequency fk (YES in steps S105 and S107), the processing proceeds to steps S106 and S108, respectively. In each of steps S106 and S108, the CPU 32 changes a resonance capacitor switching state, and the processing proceeds to a subsequent capacitor switching flow. In step S109, the CPU 32 waits until a falling edge of a ZEROX signal is detected. In step S110, the CPU 32 stops driving the switching element 58 and the switching element 59 at a timing when the falling edge of the ZEROX signal is detected. In step S111, the CPU 32 waits until a rising edge of the ZEROX signal is detected. In step S112, the CPU 32 changes the resonance capacitor switching signal at a timing when the rising edge of the ZEROX signal is detected. Subsequently, in step S113, the CPU 32 waits until a falling edge of the ZEROX signal is detected. In step S114, the CPU 32 starts driving the switching element 58 and the switching element at the driving frequency fk determined at the timing when the falling edge of the ZEROX signal is detected. If the CPU 32 determines that the capacitor switching is not needed (NO in step S105 and step S107), the processing proceeds to step S115 after the resonance capacitor is changed in steps S109 to S114. In step S115, if the CPU 32 determines that the power input should be continued (NO in step S115), the processing proceeds to step S116. In step S116, the CPU 32 updates an input power P based on a thermistor temperature, and repeats the flow to continue inputting the power. If the CPU 32 determines that the power input should be finished (YES in step S115), the power input sequence ends.

As described above, the control unit sets a driving frequency of a resonance control circuit according to at least one of a size of a recording medium and a temperature of a non-sheet-passing portion of a rotation member. Moreover, the control unit sets a resonance frequency of the resonance control circuit according to power supply needed for the resonance control circuit. Therefore, a heat generation distribution corresponding to the size of the recording medium can be formed, and the power necessary to generate heat can be supplied.

The first exemplary embodiment has been described using an example case in which a resonance capacitor is changed according to a driving frequency fk determined based on a size of a recording medium P or a temperature rise in an end portion of the fixing sleeve 1. Normally, an input power varies depending on operations such as a start-up and a printing. Thus, in some cases, the change of the resonance capacitor may not be needed depending on input power. The present exemplary embodiment will be described using an example case in which a resonance capacitor is changed according to a driving frequency fk and a necessary power. Hereinafter, a description is mainly given of the difference between the first exemplary embodiment and the present exemplary embodiment. Components and configurations similar to those of the first exemplary embodiment will be given the same reference numerals, and descriptions thereof will be omitted.

As described in the first exemplary embodiment, in a state where the resonance capacitor switching element 63 is ON and the resonance capacitors 61 and 62 have the parallel combined capacity of 8 μF, power of 900 W can be supplied if the driving frequency fk=50 kHz. On the other hand, in a state where the resonance capacitor switching element 63 is OFF and the capacity of the resonance capacitor 61 is 4 μF, power of 1050 W can be supplied if the driving frequency fk=50 kHz. In other words, if an input power can be lower than 900 W, the resonance capacitor switching element 63 is set to ON and the resonance capacitors 61 and 62 are arranged in parallel to have a combined capacity of 8 μF. This enables a power of 900 W or higher to be supplied. Therefore, only when an input power of 900 W or higher is needed, the resonance capacitor switching element 63 is set to ON and the resonance capacitors 61 and 62 are arranged in parallel to have a combined capacity of 8 μF. Such changes can reduce the number of resonance capacitor switchings as few as possible. Generally, a necessary power at the time of start-up tends to be larger than that at the time of printing to reduce the first print out time (FPOT). For example, necessary power at the time of start-up is 1000 W, and necessary power at the time of printing is 800 W. In such a case, the resonance capacitor switching element 63 is set to OFF only at the time of start-up. On the other hand, the resonance capacitor switching element 63 can be set to ON at the time of printing, thereby reducing the number of capacitor switchings.

Figure 12:
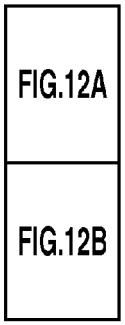
FIG. 12 (consisting of FIGS. 12A and 12B) is a flowchart illustrating processing performed according to a second exemplary embodiment.
Figure 12A:
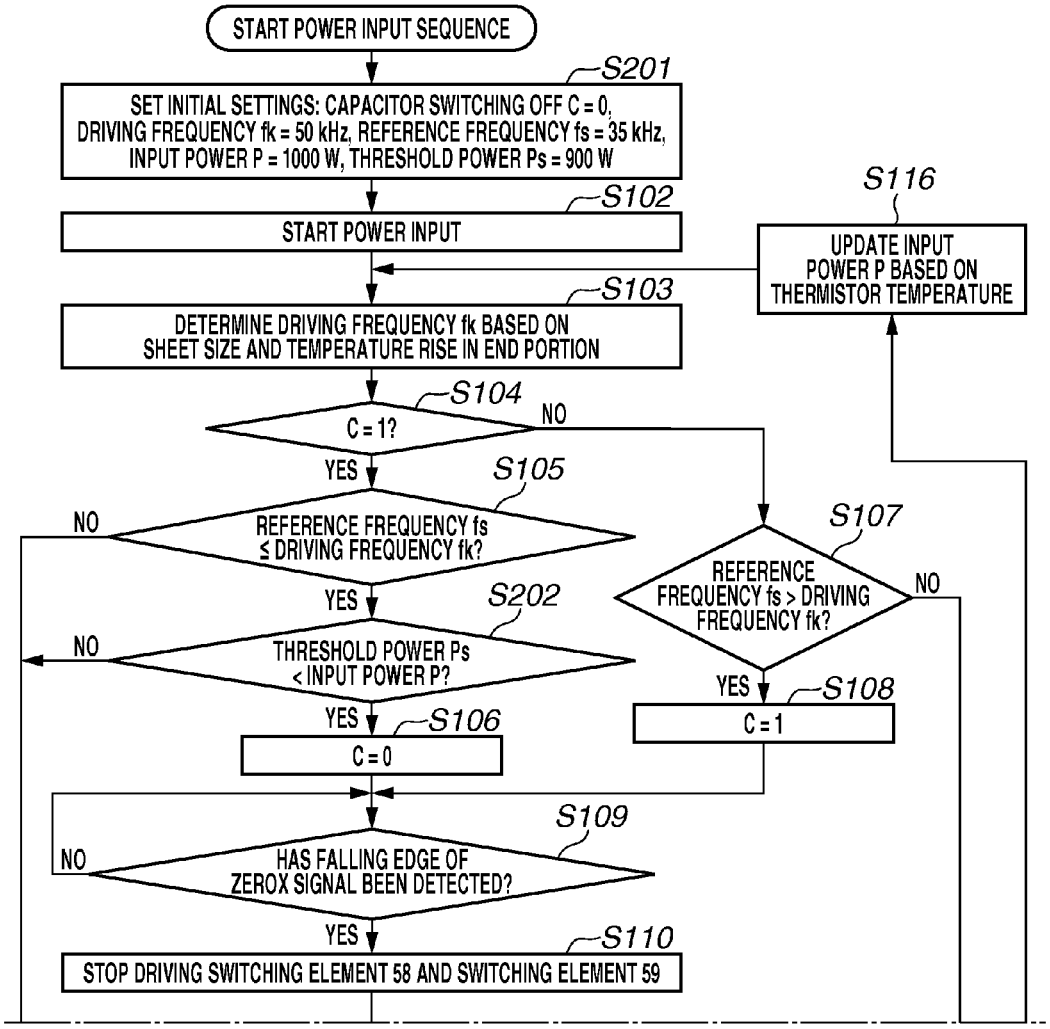
Figure 12B:
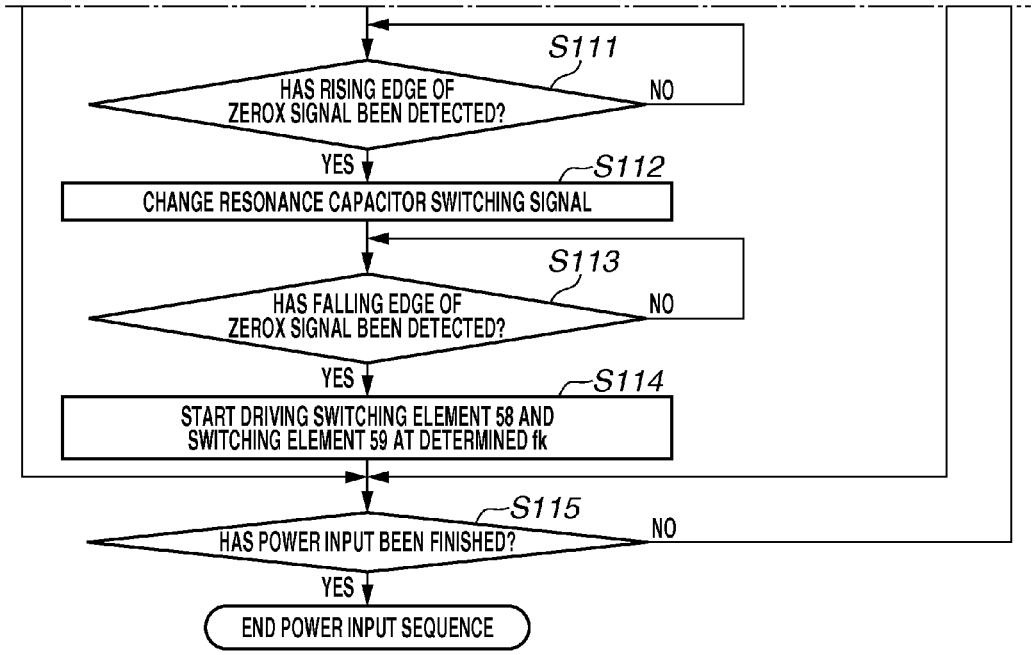

FIG. 12 (consisting of FIGS. 12A and 12B) is a flowchart illustrating processing of a power input sequence, including a capacitor switching operation, performed by the CPU 32 according to the present exemplary embodiment. Functions similar to those of the first exemplary embodiment will be given the same reference numerals, and descriptions thereof will be omitted. In step S201, when a power input sequence is started, the CPU 32 sets a capacitor switching state, a driving frequency fk of 50 kHz, a reference frequency fs of 35 kHz, an input power P of 1000 W, and a threshold power Ps of 900 V as initial settings. The term "threshold power" used herein means the power used to determine whether a capacitor switching is needed. The threshold power is set based on the power that can be supplied if a resonance capacitor switching signal is C=1. In the present exemplary embodiment, the threshold power is a fixed value regardless of a frequency. However, the present exemplary embodiment is not limited thereto. The threshold power may vary depending on a frequency. If the CPU 32 determines that an input power P is greater than a threshold power Ps where a resonance capacitor switching state is C=1 and a state of fs≤fk is satisfied (YES in step S202), the processing proceeds to steps S106 to S114 in which a resonance capacitor switching operation is performed. If the input power P is smaller than or equal to the threshold power Ps (NO in step S202), the CPU 32 does not change the resonance capacitor. Lastly, if the CPU 32 determines that the power input should be finished (YES in step S115), the power input sequence ends. In the present exemplary embodiment, therefore, the CPU 32 determines whether a resonance capacitor switching is needed based on the driving frequency fk and the input power P, unlike the first exemplary embodiment. However, the present exemplary embodiment is not limited thereto. For example, the CPU 32 may determine whether a resonance capacitor switching is needed on a mode basis such as a start-up and a printing.

As described above, the capacitor switching operation is performed, so that sufficient power can be supplied without off-resonance and regardless of a frequency, and the number of capacitor switchings can be reduced.

Figure 13:
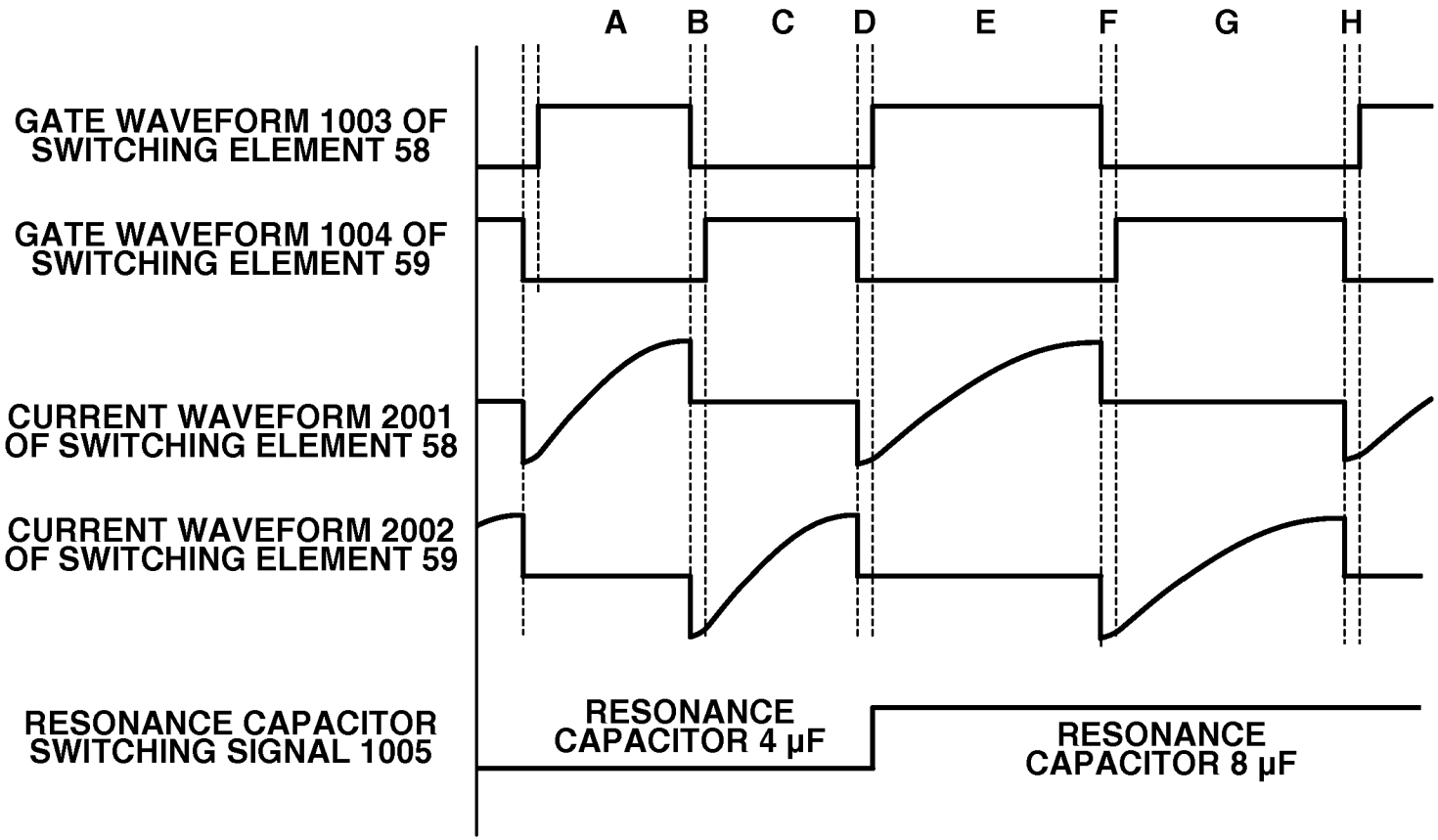
FIG. 13 is a diagram illustrating waveforms when a capacity of a resonance capacitor is changed.

FIG. 13 is a diagram illustrating waveforms when a resonance capacitor is changed according to a third exemplary embodiment. A waveform 1003 represents a gate drive waveform of a switching element 58, whereas a waveform 1004 represents a gate drive waveform of a switching element 59. Assume that each of the waveforms 1003 and 1004 is ON when a drive waveform is at a High level. Each of the waveforms 1003 and 1004 is OFF when a drive waveform is at a Low level. A waveform 2001 represents a waveform of a current flowing through the switching element 58, whereas a waveform 2002 represents a waveform of a current flowing through the switching element 59. A waveform of a switching signal 1005 represents a resonance capacitor switching signal. A description is given of operations performed in periods A, B, C and D when a resonance capacitor has a capacity of 4 μF, and periods E, F, G and H when a resonance capacitor has a capacity of 8 μF. In the following description, the switching element 58 includes a body diode D1 (not illustrated), and a low side FET includes a body diode D2 (not illustrated).

In the period A (the switching element 58 is ON, and the switching element 59 is OFF), an electric current flows through the switching element 58, an inductor of an fixing unit A, and a resonance capacitor 61 in this order. Energy is stored in the resonance capacitor 61 via the inductor of the fixing unit A, and a voltage of the resonance capacitor 61 increases. Next, in the dead time period B (both of the switching elements 58 and 59 are OFF), the electric current flows through the body diode D2, the inductor of the fixing unit A, and the resonance capacitor 61 in this order. The switching element 59 is turned on with the current flowing through a diode of the body diode D2, so that soft switching is performed. Next, in the period C (the switching element 58 is OFF, and the switching element 59 is ON), the resonance capacitor 61 continues to be charged. When the discharge of the energy stored in the inductor of the fixing unit A is finished, a direction of the resonance current changes. Accordingly, the current flows through the resonance capacitor 61, the inductor of the fixing unit A, and the switching element 59 in this order. At that time, a voltage of the resonance capacitor 61 decreases. Next, in the dead time period D (both of the switching element 58 and the 59 are OFF), the current flows through the resonance capacitor 61, the inductor of the fixing unit A, and the body diode D1 in this order. The switching element 58 is turned on with the current flowing through the body diode D1, so that soft switching is performed.

Subsequently, at an ON timing of the switching element 58, the resonant capacitor switching signal is changed. Simultaneously, the driving frequency fk of each of the switching element 58 and the switching element 59 is changed. The switching element 59 is turned on with the current flowing through the body diode D1. At the same time, the resonance capacitor and the driving frequency fk are simultaneously changed. This can prevent OFF-resonance from occurring. In the period E (the switching element 58 is ON, and the switching element 59 is OFF), the current flows through the switching element 58, the inductor of the fixing unit A, and the resonance capacitors 61 and 62 in this order. The energy is stored in the resonance capacitors 61 and 62 via the inductor of the fixing unit A, and a voltage of the resonance capacitor 61 increases. Next, in the dead time period F, (both of the switching element 58 and the switching element 59 are OFF), the current flows through the body diode D2, the inductor of the fixing unit A, and the resonance capacitors 61 and 62 in this order. The switching element 59 is turned on with the current flowing through the diode of the body diode D2, so that soft switching is performed. In the period G (the switching element 58 is OFF, and the switching element 59 is ON), the resonance capacitors 61 and 62 continue to be charged. When the discharge of the energy stored in the inductor of the fixing unit A is finished, the direction of the resonance current is changed. Thus, the current flows through the resonance capacitors 61 and 62, the inductor of the fixing unit A, and the switching element 59 in this order. At that time, a voltage of each of the resonance capacitors 61 and 62 decreases. Next, in the dead time period H (both of the switching element 58 and the switching element 59 are OFF), the current flows through the resonance capacitors 61 and 62, the inductor of the fixing unit A, and the body diode D1 in this order. The switching element 58 is turned on with the current flowing through the body diode D1, so that soft switching is performed.

Figure 14:
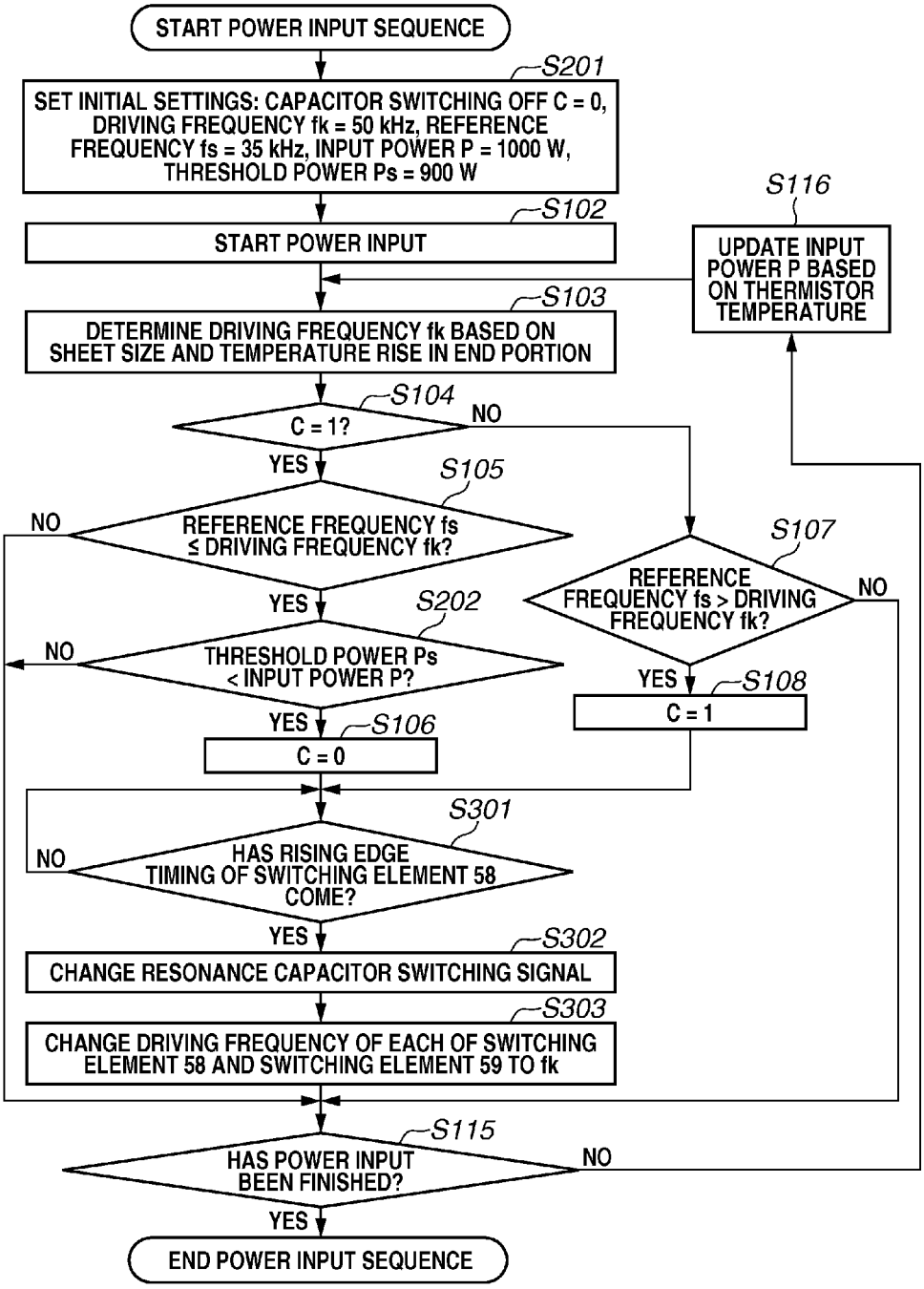
FIG. 14 is a flowchart illustrating processing performed according to a third exemplary embodiment.

Such control not only prevents off-resonance from occurring at the time of a resonance capacitor switching, but also enables the resonance capacitor switching to be made in a short time. The present exemplary embodiment has been described using the example case in which the resonance capacitor is changed. However, the present exemplary embodiment is not limited thereto as long as the frequency f can be changed. An inductor and an inductance changing circuit may be arranged in series in the fixing unit A. In such a case, a change in the inductance can change a resonance frequency f. FIG. 14 is a flowchart illustrating processing of a power input sequence, including a capacitor switching operation, performed by a CPU 32 according to the present exemplary embodiment. Functions similar to those illustrated in FIG. 12 are given the same reference numerals as those in FIG. 12, and descriptions thereof will be omitted.

In comparison with the flowchart illustrated in FIG. 12, steps S109 to S114 are replaced with steps S301 to 303. After the CPU 32 determines whether a resonance capacitor switching is needed, the processing proceeds to step S301.

In step S301, the CPU 32 turns off a gate of the switching element 59, and then waits until a predetermined dead time has elapsed. The CPU 32 waits until a rising edge timing of the switching element 58 has come. In step S302, the CPU 32 changes a resonance capacitor switching signal to change a resonance frequency f. Simultaneously, in step S303, the CPU 32 changes a driving frequency of each of the switching element 58 and the switching element 59 to fk. Therefore, when the resonance frequency f is changed, the resonance frequency f can be changed while preventing off-resonance without stopping the application of power. The present exemplary embodiment has been described using the example case in which the resonance frequency is changed from the high resonance frequency f to the low resonance frequency f. However, similar processing may be performed in a case where the resonance frequency is changed from the low resonance frequency f to the high resonance frequency f. Moreover, the present exemplary embodiment has been described using the example case in which a change in the resonance frequency f and the change in the driving frequency fk are made in synchronization with a rising edge of the switching element 58. However, the present exemplary embodiment is not limited thereto. The change in a resonance frequency f and the change in the driving frequency fk may be made in synchronization with a rising edge of the switching element 59.

In each of the first and second exemplary embodiments, a resonance capacitor switching operation is performed in synchronization with the ZEROX signal. In the present exemplary embodiment, the resonance capacitor switching operation is performed without synchronization with the ZEROX signal. However, each of the first and second exemplary embodiments is not limited thereto as long as switching is stopped when the resonance capacitor is changed even without synchronization with the ZEROX signal. The present exemplary embodiment is not limited thereto as long as the resonance frequency f and the driving frequency fk can be changed in synchronization with a rising edge of the switching element 58 or the switching element 59 even if synchronized with the ZEROX signal.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-148885, filed Jul. 22, 2014, and No. 2015-123160, filed Jun. 18, 2015, which are hereby incorporated by reference herein in their entirety.

What is claimed is:

1. A fixing apparatus configured to fix an image on a recording medium, comprising:

a tubular rotation member including a conductive layer;

a helical coil disposed inside the rotation member, a helical axis of the coil extending in a direction along a generatrix direction of the rotation member;

a resonance circuit, including a resonance capacitor, formed with the rotation member and the coil;

a resonance inverter configured to control the resonance circuit; and a control unit configured to control electric power supplied to the resonance inverter, wherein the conductive layer generates heat with electromagnetic induction caused by magnetic flux generated through the coil, and the image formed on the recording medium is fixed on the recording medium with heat of the rotation member, wherein the control unit sets a driving frequency of the resonance inverter according to at least one of a size of the recording medium and a temperature of a non-sheet-passing portion of the rotation member, wherein the control unit changes a resonance frequency of the resonance circuit according to the set driving frequency, and wherein the apparatus is capable of executing a first fixing mode in which the resonance frequency is set to a first resonance frequency and the driving frequency is set to a first driving frequency and a second fixing mode in which the resonance frequency is set to a second resonance frequency lower than the first resonance frequency and the driving frequency is set to a second driving frequency lower than the first driving frequency.

2. The fixing apparatus according to claim 1, wherein the control unit changes a capacity of the resonance capacitor to change the resonance frequency.

3. The fixing apparatus according to claim 2, wherein the capacity of the resonance capacitor set in the second fixing mode is larger than the capacity of the resonance capacitor set in the first fixing mode.

4. The fixing apparatus according to claim 1, wherein the control unit changes the resonance frequency after turning off driving of the resonance inverter.

5. The fixing apparatus according to claim 1, wherein the conductive layer generates heat by mainly an induced current flowing to a circumferential direction of the conductive layer.

6. The fixing apparatus according to claim 1, wherein 70% or more of the magnetic flux generated by the coil passes outside the conductive layer.

7. The fixing apparatus according to claim 1, wherein the rotation member is a film.

8. The fixing apparatus according to claim 1, wherein the coil is unique inside the rotation member.

9. The fixing apparatus according to claim 1, wherein the resonance circuit include an inductor, and wherein the control unit changes a inductance of the inductor according to the set driving frequency.

10. The fixing apparatus according to claim 1, wherein the first driving frequency is equal to or higher than the first resonance frequency, and the second driving frequency is equal to or higher than the second resonance frequency.

11. The fixing apparatus according to claim 1, wherein the apparatus executes the first fixing mode while fixing the image on a first size recording medium, and the apparatus executes the second fixing mode while fixing the image on a second size recording medium having a smaller width than the first size recording medium.

12. A fixing apparatus configured to fix an image on a recording medium, comprising:

a tubular rotation member including a conductive layer;

a helical coil disposed inside the rotation member, a helical axis of the coil extending in a direction along a generatrix direction of the rotation member;

a resonance circuit, including a resonance capacitor, formed with the rotation member and the coil;

a resonance inverter configured to control the resonance circuit; and a control unit configured to control electric power supplied to the resonance inverter, wherein the conductive layer generates heat with electromagnetic induction caused by magnetic flux generated through the coil, and the image formed on the recording medium is fixed on the recording medium with heat of the rotation member, wherein the control unit sets a driving frequency of the resonance inverter according to at least one of a size of the recording medium and a temperature of a non-sheet-passing portion of the rotation member, wherein the control unit changes a resonance frequency of the resonance circuit according to electric power necessary to perform fixing processing, and wherein the apparatus is capable of executing a first mode in which the resonance frequency is set to a first resonance frequency and the driving frequency is set to a first driving frequency and a second mode in which the resonance frequency is set to a second resonance frequency lower than the first resonance frequency and the driving frequency is set to a second driving frequency lower than the first driving frequency.

13. The fixing apparatus according to claim 12, wherein the control unit changes a capacity of the resonance capacitor to change the resonance frequency.

14. The fixing apparatus according to claim 12, wherein the control unit changes the resonance frequency after turning off driving of the resonance inverter.

15. The fixing apparatus according to claim 12, wherein the conductive layer generates heat by mainly an induced current flowing to a circumferential direction of the conductive layer.

16. The fixing apparatus according to claim 12, the coil is unique inside the rotation member.

17. The fixing apparatus according to claim 12, wherein the resonance circuit include an inductor, and wherein the control unit changes a inductance of the inductor according to the set driving frequency.

18. The fixing apparatus according to claim 13, wherein the capacity of the resonance capacitor set in the second fixing mode is larger than the capacity of the resonance capacitor set in the first fixing mode.

19. The fixing apparatus according to claim 12, wherein the first driving frequency is equal to or higher than the first resonance frequency, and the second driving frequency is equal to or higher than the second resonance frequency.

20. The fixing apparatus according to claim 12, wherein the apparatus executes the first fixing mode while fixing the image on a first size recording medium, and the apparatus executes the second fixing mode while fixing the image on a second size recording medium having a smaller width than the first size recording medium.

21. A fixing apparatus configured to fix an image on a recording medium, comprising:

a tubular rotation member including a conductive layer;

a helical coil disposed inside the rotation member, a helical axis of the coil extending in a direction along a generatrix direction of the rotation member;

a resonance circuit, including a resonance capacitor, formed with the rotation member and the coil;

a resonance inverter configured to control the resonance circuit; and a control unit configured to control electric power supplied to the resonance inverter, wherein the conductive layer generates heat with electromagnetic induction caused by magnetic flux generated through the coil, and the image formed on the recording medium is fixed on the recording medium with heat of the rotation member, wherein the control unit sets a driving frequency of the resonance inverter according to at least one of a size of the recording medium and a temperature of a non-sheet-passing portion of the rotation member, and wherein after turning off driving of the resonance inverter, the control unit changes a resonance frequency of the resonance circuit according to the set driving frequency.

22. A fixing apparatus configured to fix an image on a recording medium, comprising:

a tubular rotation member including a conductive layer;

a helical coil disposed inside the rotation member, a helical axis of the coil extending in a direction along a generatrix direction of the rotation member;

a resonance circuit, including a resonance capacitor, formed with the rotation member and the coil;

a resonance inverter configured to control the resonance circuit; and a control unit configured to control electric power supplied to the resonance inverter, wherein the conductive layer generates heat with electromagnetic induction caused by magnetic flux generated through the coil, and the image formed on the recording medium is fixed on the recording medium with heat of the rotation member, wherein the control unit sets a driving frequency of the resonance inverter according to at least one of a size of the recording medium and a temperature of a non-sheet-passing portion of the rotation member, and wherein after turning off driving of the resonance inverter, the control unit changes a resonance frequency of the resonance circuit according to electric power necessary to perform fixing processing.

* * * * *